US005352149A

United States Patent [19]

Melashenko et al.

[11] Patent Number: 5,352,149

[45] Date of Patent: Oct. 4, 1994

[54] CHILDREN'S PLAY STRUCTURE WITH INTERCHANGEABLE SCENE

[75] Inventors: Connie R. Melashenko, Redlands, Calif.; Erik W. Nielsen, Boring, Oreg.; Robert A. Melashenko, Redlands, Calif.

[73] Assignee: Calapitter Creations, Inc., Redlands, Calif.

[21] Appl. No.: 57,190

[22] Filed: May 3, 1993

Related U.S. Application Data

[63] Continuation of Ser. No. 697,081, May 8, 1991, abandoned.

[51] Int. Cl.[5] ..... A63H 3/52; A63H 33/00; A47G 5/00

[52] U.S. Cl. ..... 446/478; 160/135; 160/351; 446/490

[58] Field of Search ..... 446/82, 478, 476, 479, 446/487, 488, 489, 490, 901; 135/900, 901, 903, DIG. 9; 160/371, 369, 135, 351; 52/222, 63

[56] References Cited

U.S. PATENT DOCUMENTS

| | | | |
|---|---|---|---|
| 3,571,999 | 3/1971 | Downing | 160/351 X |
| 3,709,237 | 1/1973 | Smith | 160/135 X |
| 3,913,598 | 10/1975 | Gluting, Jr. et al. | 160/135 X |
| 4,001,987 | 1/1977 | Coulthard | 160/135 X |
| 4,373,570 | 2/1982 | Nussdorf et al. | 160/352 |
| 4,516,620 | 5/1985 | Malhern | 160/351 |
| 4,798,019 | 1/1989 | Sury et al. | 135/901 X |
| 4,842,035 | 6/1989 | Thompson | 160/351 X |
| 4,992,068 | 2/1991 | Conrad | 446/82 X |
| 5,069,623 | 12/1991 | Peat | 446/476 X |
| 5,070,665 | 12/1991 | Marrin et al. | 160/352 X |

FOREIGN PATENT DOCUMENTS

| | | | |
|---|---|---|---|
| 2373312 | 7/1978 | France | 446/478 |

*Primary Examiner*—Robert A. Hafer
*Assistant Examiner*—D. Neal Muir
*Attorney, Agent, or Firm*—Dorsey & Whitney

[57] ABSTRACT

A children's play structure includes a frame having hinging sections capable of being arranged into a free-standing structure and interchangeable panels capable of removable attachment to the frame to provide multiple scenes on the plurality of hinging sections of the frame. The hinging sections of the frame comprise elongated beams or pipes joined at their opposite ends to form an open rectangular frame pivotally joined to adjacent hinging sections. In a first embodiment, the panels are provided by a piece of canvas folded over on itself and stitched together at opposite ends to form a sock which is dropped onto the frame. The canvas is easily replaced by another canvas having different scenes or murals to change the theme or environment of the play structure. In second and third embodiments, separate panels are removably attached to the different hinging sections of the frame by velcro patches attached to the frame and to the back sides of the panels or to portions of the upper and lower edges of the panel which are wrapped around horizontal frame members of the hinging sections. The frame in the third embodiment is comprised of lengths of pipe removable fastened to common pivotable columnar structures at the interfaces between adjacent hinging sections of the frame.

7 Claims, 4 Drawing Sheets

CHILDREN'S PLAY STRUCTURE WITH INTERCHANGEABLE SCENE

This is a continuation of application Ser. No. 07/697,081 filed May 8, 1991 now abandoned.

BACKGROUND OF THE INVENTION

1. Field of the Invention

The present invention relates to children's play structures, and more particularly to play structures designed to provide the child with a particular theme or environment through the use of various scenes, murals or the like.

2. History of the Prior Art

It is known to provide a child's play structure such as a playhouse or similar free-standing structure to enhance the child's play. Such structures are often provided with scenes, murals or the like which impart a particular theme or environment such as a school classroom, a doctor's office, a store, a spaceship or the like. The scenes or murals depict enough to suggest the desired theme or environment, while at the same time allowing the child to use his or her imagination with respect to some of the details. The child is thus able to act out various activities and sequences of events using the play structure as a prop.

Examples of children's play structures of this type are provided by U.S. Pat. No. 984,735 of Bailey, U.S. Pat. No. 4,919,982 of Hayes, U.S. Pat. No. 4,765,006 of Jackson, et al., U.S. Pat. No. 4,407,494 of Hummel, U.S. Pat. No. 1,881,356 of Gold, U.S. Pat. No. 3,548,552 of McBride, U.S. Pat. No. 2,837,777 of White, U.S. Pat. No. 2,608,726 of Olson, U.S. Pat. No. 1,982,433 of Hungerford, U.S. Pat. No. 1,647,733 of Keichline, U.S. Pat. No. Des. 159,019 of Valentine, U.S. Pat. No. 4,884,988 of McMurray, U.S. Pat. No. 4,696,652 of Reeder, et al. and U.S. Pat. No. 4,556,391 of Tardivel, et al.. Such play structures are often made in a foldable or collapsible configuration so that they can be folded or otherwise substantially reduced in size to facilitate storage thereof when not in use. Such structures are assembled or erected to form a free-standing structure for use. As shown in some of the patents noted above, the play structures may form an enclosure to simulate a room or a house, and can be provided with partitions or other interior members which divide the interior into plural rooms, compartments or the like. Still other structures, such as the considerably smaller playhouse for use with paper dolls shown in the Hungerford patent noted above, provide different partitions or additions to change portions of the structure somewhat.

While conventional children's play structures such as those described in the patents noted above provide a variety of different forms, themes, ideas and features, such structures are somewhat limited when it comes to their ability to easily convert to different themes or environments. Most such structures, for example, are designed to provide one and only one theme or environment with no interchangeability being possible. Still others provide for some interchangeability, but typically at the expense of complexity and an inherent difficulty in making the changes.

Accordingly, it is an object of the present invention to provide a children's play structure of relatively simple, low-cost construction which is easily folded or disassembled for storage, and which has multiple scenes or murals which are easily replaced to change the theme or environment of the structure.

BRIEF SUMMARY OF THE INVENTION

Children's play structures according to the invention utilize one or more interchangeable panels in conjunction with a frame. Each panel is comprised of a scene or mural or portion thereof representing a particular theme or environment. The interchangeable panels are easily installed on and removed from the frame so as to change the theme or environment of the play structure. The frame, which is erected to form a free-standing structure when in use, is foldable into a compact structure to facilitate transportation and storage.

Such children's play structures may utilize a frame comprised of a plurality of hinging sections forming a generally enclosed free-standing structure which includes a back, opposite sides and two hinging front sections when the frame is erected for use. The hinging sections are of generally planar configuration and have opposite broad surfaces. Each hinging section is comprised of beams of wood, plastic or other appropriate construction joined at the opposite ends thereof to form a generally rectangular configuration having an open interior. Each hinging section is pivotally coupled to at least one other hinging section in hinging, pivotable fashion.

In a first embodiment according to the invention, a plurality of interchangeable multi-panel members are provided. The members are easily installed on the frame, one at a time, to provide the frame with a plurality of panels depicting various scenes or murals which impart a desired theme or environment to the play structure. The members are easily removed from the frame so that another member can be installed on the frame to change the theme or environment of the play structure. Each member has opposite sides disposed against the opposite broad surfaces of the hinging sections of the frame when installed on the frame. Each hinging section of the frame is thereby provided with a panel having a particular scene or mural or portion thereof thereon. The scenes or murals are painted or printed on one or both of the opposite sides of the member. The member is preferably comprised of flexible material such as a length of canvas or similar cloth folded over on itself at a top edge thereof and stitched together at the opposite ends thereof to form a sock. The sock is dropped over the frame to install the member. To assist in holding the member in place on the frame, opposing portions of the opposite sides of the member adjacent the bottom thereof are provided with fastening members such as velcro strips. Such members are fastened together beneath the frame after the member is draped over the frame in order to hold the panel in place.

The immediately preceding reference and all following references herein to velcro are intended to refer to hook and loop fasteners sold under the trademark "Velcro", which fasteners are representative of fasteners suitable for use in the present invention.

In a second embodiment according to the invention, each hinging section of the frame previously described is provided with a separate panel having a scene or mural or portion thereof painted or printed thereon. The panel which is approximately the same size as the hinging section of the frame is removably attached thereto by appropriate fasteners such as small velcro patches mounted on the frame and secured to the back side of mating portions of the panel. The panels, which are interchangeable and which can be made from a laminate of paper stock or of other appropriate construction, are easily removed from the various hinging sections of the frame by simply pulling the panel away from the frame to separate the velcro patches. A replacement panel containing a different desired scene or mural or portion thereof and which is provided with velcro patches at the back side thereof is then easily installed over the hinging section of the frame by attaching the velcro patches thereof to the velcro patches mounted on the frame.

In a third and preferred embodiment according to the invention, adjacent pairs of the hinging sections of the frame share a common vertical structure having a rod disposed within a hollow tube. Opposite ends of the rod are mounted in a pair of brackets pivotably coupled to a pair of holders receiving the opposite ends of the hollow tube in which the rod is disposed. The brackets receive plugs for mounting hollow pipes forming the upper and lower frame members of one hinging section of the frame. The holders receive plugs for mounting hollow pipes forming the upper and lower frame members of the adjacent hinging section of the frame. The pivotable coupling of the brackets to the holders permits pivoting movement of the hinging sections of the frame relative to each other. The plugs are removable from the brackets and holders to permit disassembly of the frame. Panels comprising flexible sheets of canvas or similar material are mounted on the hinging sections by wrapping the upper and lower edges of each sheet around the upper and lower frame members of the hinging section and securing the edges to the sheet with velcro fasteners. The fasteners are pulled apart to permit removal of the panel and replacement by a different panel.

BRIEF DESCRIPTION OF THE DRAWINGS

The foregoing and other objects, features and advantages of the invention will be apparent from the following more particular description of preferred embodiments of the invention, as illustrated in the accompanying drawings, in which.

DETAILED DESCRIPTION

Figure 1:
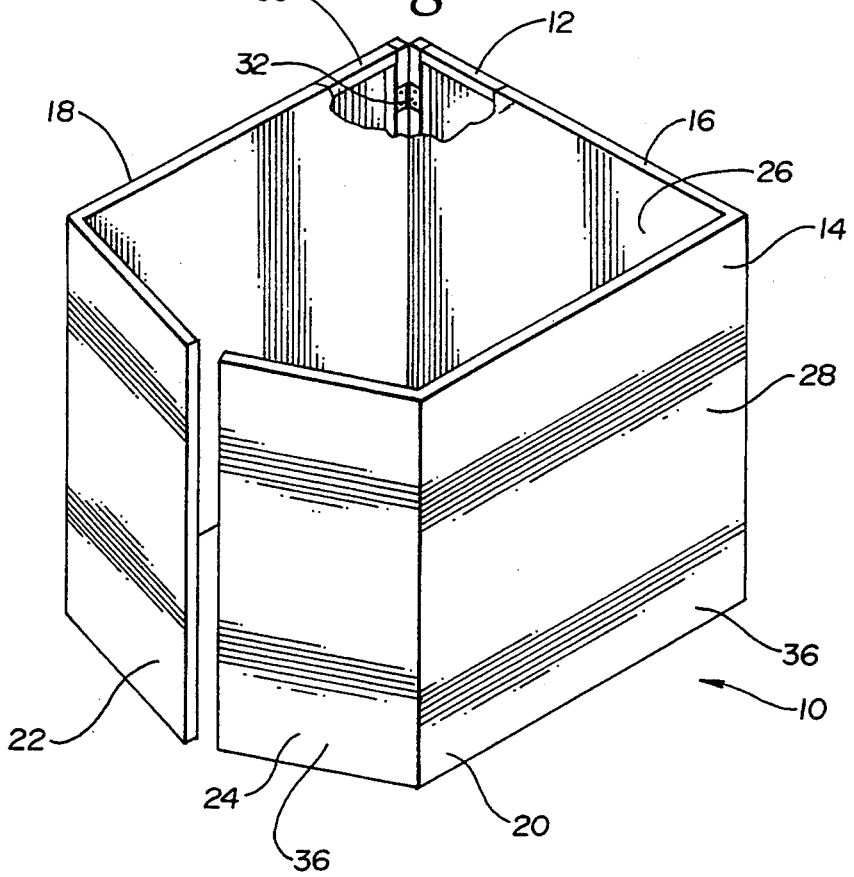
FIG. 1 is a perspective view of a children's play structure in accordance with the invention with a small portion of the multi-panel member of a first embodiment shown broken away to illustrate the details of the frame.

FIG. 1 illustrates a children's play structure 10 according to the invention, which includes a frame 12. In accordance with a first embodiment of the invention, an interchangeable multi-panel member 14 is disposed over the frame 12. The frame 12 and the included member 14 are shown formed into a generally enclosed free-standing structure in FIG. 1.

The frame 12 is comprised of a plurality of different hinging sections thereof, each of which is pivotally coupled to at least one other adjacent hinging section. As illustrated in FIG. 1, the hinging sections of the frame 12 include a back 16, opposite sides 18 and 20, and a pair of hinging front sections 22 and 24. The hinging front sections 22 and 24 which are capable of undergoing pivoting movement relative to the sides 18 and 20 to which they are hingedly attached act as doors to provide access to the interior of the generally enclosed play structure 10. Either one or both of the front sections 22 and 24 can be swung inwardly or outwardly by a child desiring to gain entrance to the interior of the play structure 10. Once inside, the child can move the front sections 22 and 24 to form a generally continuous wall across the front of the play structure 10 so that the child is then enclosed within the structure 10.

Each of the hinging sections, which include the back 16, the sides 18 and 20 and the front sections 22 and 24, is of generally planar configuration so as to have opposite broad surfaces. The member 14 has opposite sides 26 and 28 thereof disposed against the opposite broad surfaces of the hinging sections. With the play structure 10 arranged as shown in FIG. 1, the side 26 of the member 14 resides on the inside of such structure with the opposite side 28 residing on the outside of the structure 10.

Figure 2:
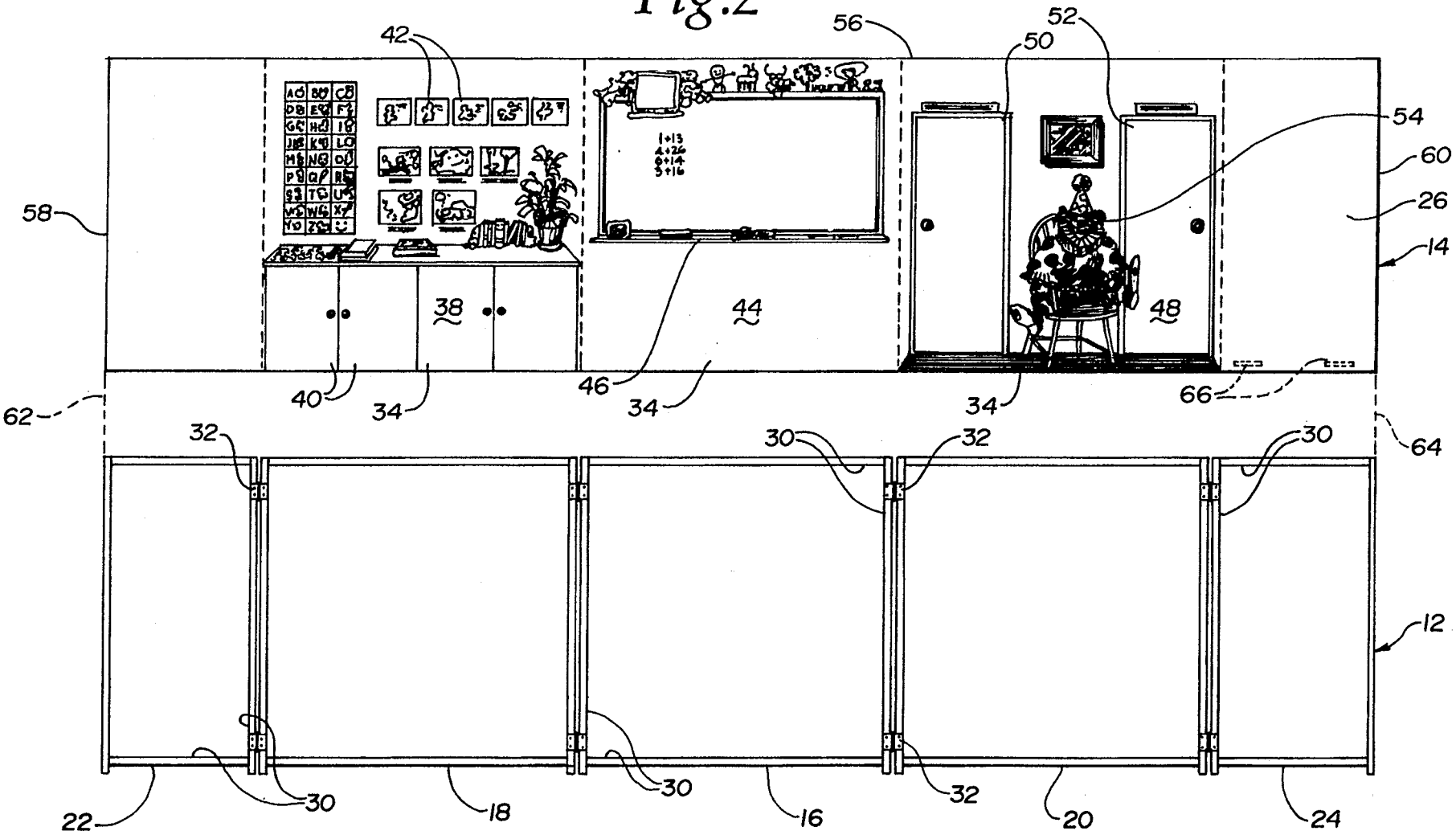
FIG. 2 is an elevation view of the frame of the play structure of FIG. 1 which has been opened to assume a linear configuration and illustrating the multi-panel member of the first embodiment in a similar linear configuration and the interrelationship therebetween.

The details of the frame 12 and the multi-panel member 14 are shown in FIG. 2 in which both the frame 12 and the member 14 are shown extended into a generally linear configuration rather than in the enclosed configuration shown in FIG. 1. Each of the hinging sections of the frame 12 comprising the back 16, the sides 18 and 20 and the front sections 22 and 24 is comprised of four different beams 30 of wood, plastic or other appropriate construction joined at their opposite ends to form a generally rectangular configuration having an open interior. Adjacent hinging sections are coupled by a pair of hinges 32 mounted on the adjacent beams 30.

Because the various hinging sections of the frame 12 are pivotal relative to each other due to the hinging interconnection therebetween, it will be appreciated that the frame 12 is easily folded into a compact, generally planar configuration to facilitate storage thereof when the play structure 10 is not in use. Conversely, the hinged interconnection of the hinging sections permits the frame 12 to be easily unfolded and erected to form a free-standing, generally enclosed structure as in the case of FIG. 1 where the adjacent hinging sections are disposed essentially at right angles to one another. Also, as will be appreciated from the discussion to follow, the frame 12 can be constructed using other than the beams 30 and the hinges 32. Thus, the frame 12 can be comprised of various different configurations of generally planar members foldable or otherwise hingedly coupled to adjacent members. Alternatively, the frame 12 can be comprised of a plurality of discrete and separate generally planar members which are joined together at desired angles to form the assembled frame 12 when ready for use.

The interchangeable multi-panel member 14 is also shown in FIG. 2. In the present example, the member 14 is comprised of flexible material such as canvas or similar cloth having a succession of panels 34 with scenes or murals printed or painted thereon. With the member 14 installed on the frame 12, each panel 34 is disposed over and is generally continuous with the side of one of the hinging sections 16, 18, 20, 22 and 24. The successive panels 34 shown in FIG. 2 are on the side 26 of the member 14. As shown in FIG. 1, the opposite side 28 of the member 14 can also be provided with a succession of panels 36 with scenes or murals printed or painted thereon and each being disposed over and generally coextensive with a different one of the hinging sections 16, 18, 20, 22 and 24.

The successive panels 34 on the side 26 of the member 14 shown in FIG. 2 comprise different walls of a classroom providing a school theme or environment. Thus, one such panel 38 which resides on the inside of the side 18 when the panel 14 is installed on the frame 12 depicts a utility area of the classroom including cabinets 40 and student work papers 42. A second panel 44 residing on the inside of the back 16 with the member 14 installed over the frame 12 depicts a classroom wall having a blackboard 46. A third panel 48 which resides on the inside of the side 20 with the member 14 installed on the frame 12 depicts another wall of the classroom including two different doors 50 and 52 and a seated clown 54.

Figure 3:
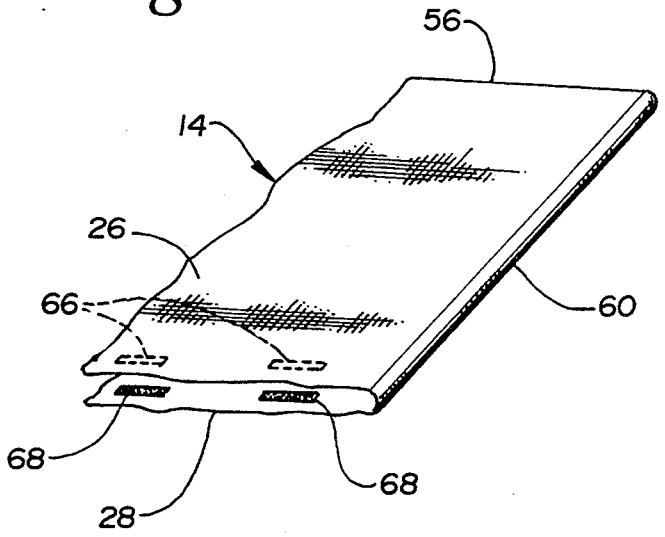
FIG. 3 is a perspective view of an end portion of the multi-panel member of the first embodiment illustrating opposite fastening members which may be used to assist in securing the member in place on the frame.

The piece of canvas comprising the member 14 with its succession of different panels is folded over on itself at a top edge 56 to form the opposite sides 26 and 28 of the member 14. With the canvas thus folded, opposite ends 58 and 60 thereof are stitched together so that the member 14 forms a "sock". This "sock" is simply dropped over the frame 12, as illustrated by the dotted lines 62 and 64 in FIG. 2, to install the member 14 on the frame 12. With the member 14 thus draped over the frame 12, the member 14 is secured in place thereon by opposite fastening members in the form of velcro strips 66 and 68 secured to the lower edges of the sides 26 and 28 of the member 14. FIG. 3 illustrates an end portion of the member 14 including two different pairs of the velcro strips 66 and 68. The velcro strips 66 which are shown in dotted outline in FIG. 3 are also shown in dotted outline in FIG. 2. With the member 14 draped over the frame 12, the velcro strips 66 and 68 reside just below the lower beam 30 of each hinging section of the frame 12. By pressing the opposite velcro strips 66 and 68 into contact with one another, the opposite sides 26 and 28 of the member 14 are thereby secured together at the underside of the lower beam 30. Although not shown in FIG. 2, the opposite velcro strips 66 and 68 are spaced apart along the entire bottom edge of the member 14 so that a plurality of the pairs of such strips are located within each of the hinging sections of the frame 12.

Removal of the member 14 from the frame 12 involves the simple process of pulling apart the opposite sides 26 and 28 of the member 14 to separate the pairs of velcro strips 66 and 68. With the velcro strips 66 and 68 separated along the bottom edges of the member 14, the member 14 may then be lifted off of the frame 12. Thereafter, the frame 12 can be folded for storage, or a different multi-panel member 14 providing a different theme or environment can be mounted on the frame 12 in the manner just described.

Figure 4:
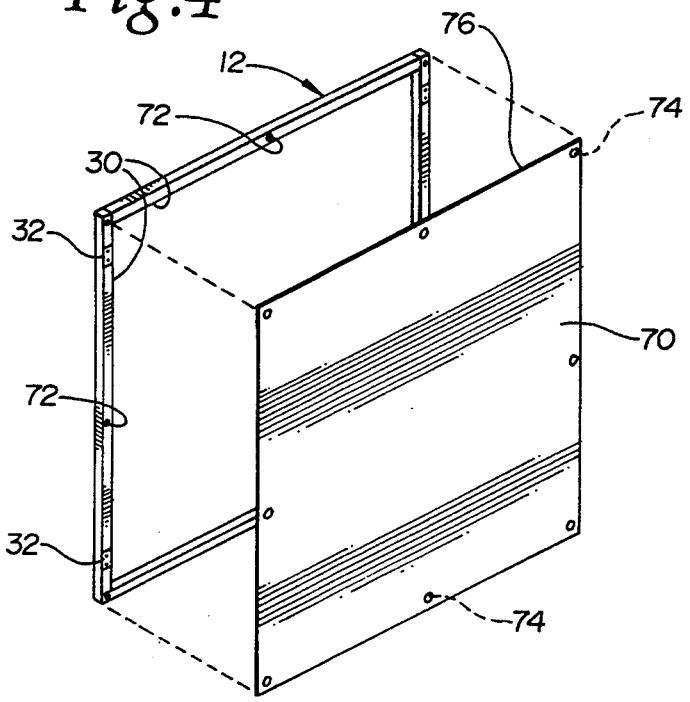
FIG. 4 is a perspective view of a section of the frame of FIG. 1 together with a mating panel in accordance with a second embodiment and showing the manner in which the mating panel is removably secured to the section of the frame.

A second embodiment in accordance with the invention is shown in FIG. 4. In the second embodiment, each hinging section of the frame 12 is provided with a separate interchangeable panel such as a panel 70 shown in FIG. 4. The hinging section of the frame 12 shown in FIG. 4 can comprise any of the sections 16, 18 and 20 shown in FIG. 2. The hinging panel sections 22 and 24 shown in FIG. 2 which are approximately half the width of the sections 16, 18 and 20 have panels of conforming size and configuration removably attached thereto in a manner similar to the arrangement shown in FIG. 4.

In the present example of the second embodiment as shown in FIG. 4, the panel 70 is removably attached to the section of the frame 12 shown therein by velcro patches. A first plurality of velcro patches 72 are mounted at the ends and the mid-points of the beams 30. A second plurality of velcro patches 74 are secured to a backside 76 of the panel 70. The velcro patches 74, which are shown in dotted outline in FIG. 4 and which are mounted on the backside 76 of the panel 70, align with the velcro patches 72 on the section of the frame 12 when the panel 70 is placed against the frame 12. The velcro patches 74 adhere to the velcro patches 72 to mount the panel 70 on the frame 12. Removal of the panel 70 from the frame 12 is accomplished by pulling the panel 70 away from the frame 12 to separate the velcro patches 74 from the velcro patches 72.

It should be understood that the velcro patches 72 and 74 provide but one example of the manner in which the panel 70 may be removably attached to the hinging section of the frame 12. Other arrangements are possible, including those in which mechanical snaps are mounted on the backside 76 of the panel 70 and on the frame 12.

As in the case of the multi-panel member 14 shown in FIG. 2, the panel 70 of the arrangement of FIG. 4 can have a separate scene or mural printed or painted thereon. Alternatively, the scene printed or painted on the panel 70 can comprise a portion of a continuous mural or scene extending across part or all of the entire frame 12. The panel 70 may be of any appropriate construction such as a pressed paper laminate.

The second embodiment of the invention shown in FIG. 4 is preferred over the first embodiment shown in FIGS. 1–3 for most applications of the invention. Providing a plurality of the individual panels 70 shown in FIG. 4 is typically less expensive than preparation of the sock of canvas or other material comprising the multi-panel member 14 of FIGS. 1–3. In addition, the individual panels 70 are generally easier to install and remove than is the multi-panel member 14 which may be relatively large and cumbersome, particularly for one person to handle.

Figure 5:
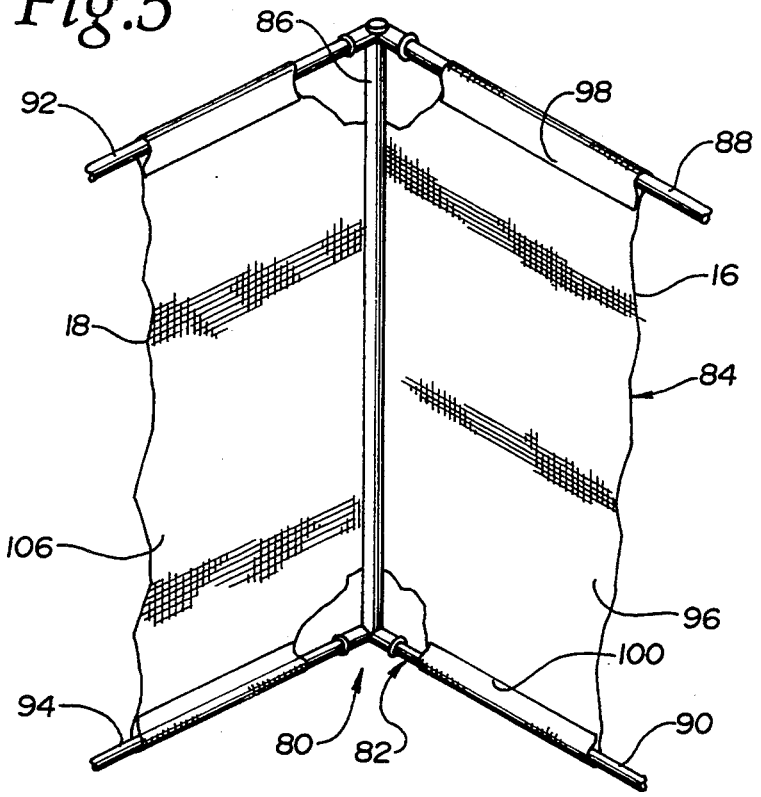
FIG. 5 is a perspective view of a portion of a third and preferred embodiment in accordance with the invention with portions of adjacent panels shown broken away to illustrate the details of the frame.
Figure 6:
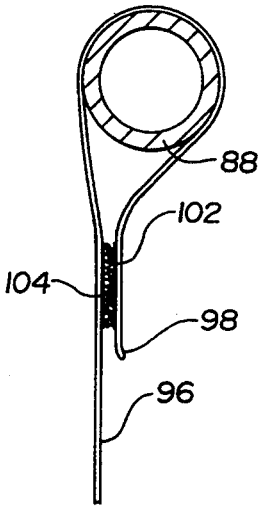
FIG. 6 is a sectional view of one of the frame members and a portion of an associated panel of the embodiment of FIG. 5 illustrating the manner in which the panel is removably mounted on the frame.
Figure 7:
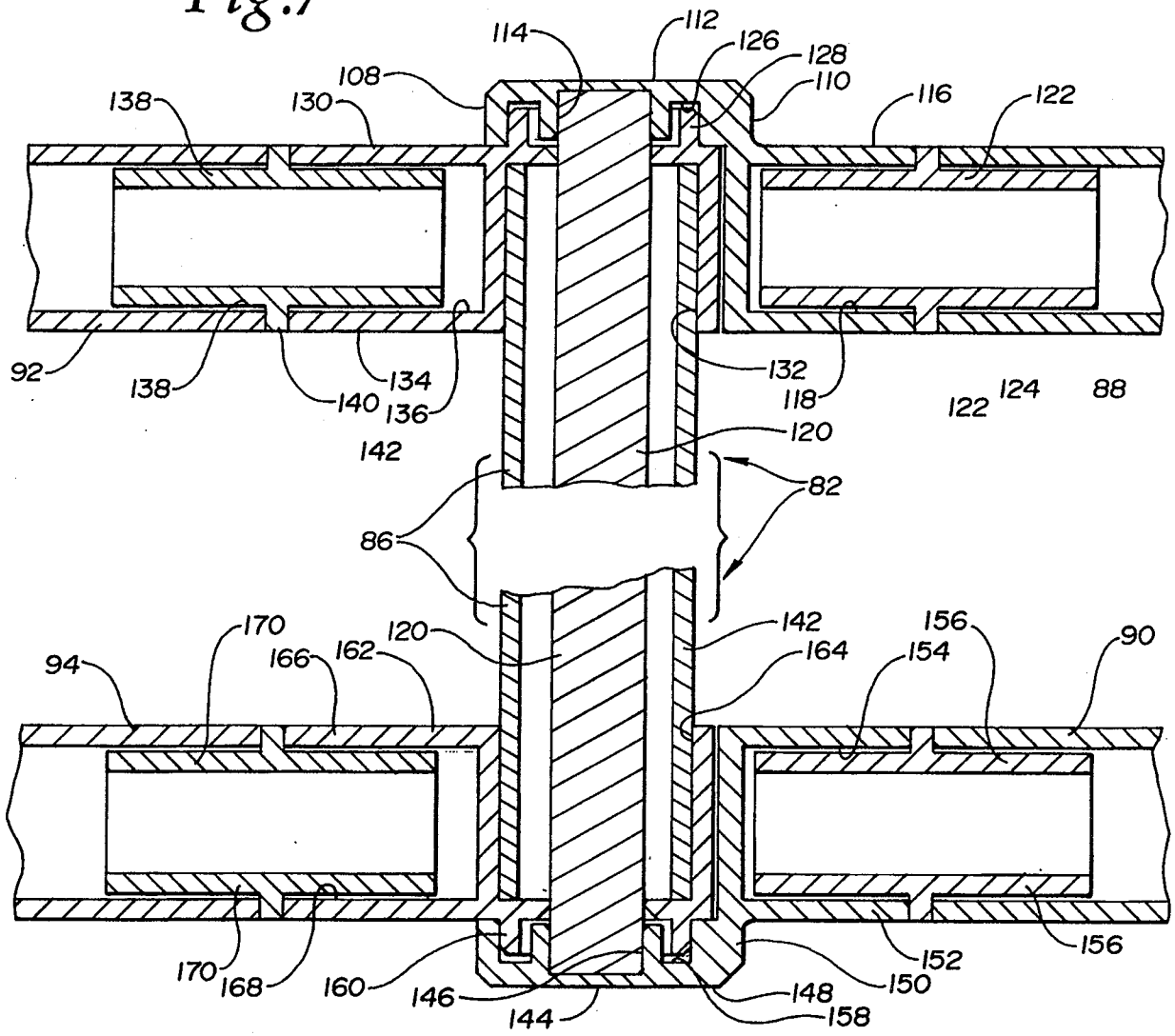
FIG. 7 is a sectional view of portions of the frame of the embodiment of FIG. 5 illustrating the manner in which adjacent hinging sections of the frame share a common pivotable columnar structure.

A third and preferred embodiment in accordance with the invention is illustrated in FIGS. 5–7. As shown in FIG. 5, a children's play structure 80 in accordance with the third embodiment of the invention includes a frame 82 and a plurality of interchangeable panels 84. Only a portion of the frame 82 is shown in FIG. 5, inasmuch as the frame 82 assumes the general configuration of the frame 12 in the embodiment of FIG. 1. As shown in FIG. 1, the frame 12 includes the back 16, the opposite sides 18 and 20 and the two hinging front sections 22 and 24. The frame 82 of FIG. 5 is similarly configured, with only portions of the back 16 and one of the opposite sides 18 thereof being shown for simplicity of illustration.

As shown in FIG. 5, the hinging sections formed by the back 16 and the side 18 share a common pivotal columnar structure 86. The structure 86 thus forms one of the vertical members of the back 16 as well as one of the vertical members of the side 18. The back 16 also includes upper and lower frame members in the form of lengths of pipe 88 and 90 respectively. The pipes 88 and 90 are joined to the structure 86 at the top and bottom ends thereof. Also joined to the structure 86 at the top and bottom ends thereof are lengths of pipe 92 and 94 respectively forming upper and lower frame members of the side 18 of the frame 82. As described hereafter in connection with FIG. 7, the common pivotal columnar structure 86 is configured to permit pivoting movement of the pipes 88 and 90 relative to the pipes 92 and 94 so that the back 16 may undergo pivoting movement relative to the side 18.

FIG. 5 shows two of the panels 84 comprising a part of the children's play structure 80. A first such panel 96 is mounted on and forms a part of the back 16 by securing opposite upper and lower edges 98 and 100 thereof to the pipes 88 and 90 respectively. The upper edge 98 of the panel 96 is wrapped around the pipe 88 and secured to the panel 96 by a plurality of pairs of velcro patches 102 and 104. As shown in FIG. 6, the velcro patch 102 is mounted on the back of the edge 98 as folded over the pipe 88 so as to interface with the velcro patch 104 mounted on the front of the panel 96. A plurality of pairs of the velcro patches 102 and 104 are secured to the panel 96 in spaced-apart fashion along the length of the pipe 88. The lower edge 100 of the panel 96 is wrapped around the pipe 90 and secured to the panel 96 in similar fashion using pairs of the velcro patches 102 and 104.

Use of the pairs of velcro patches 102 and 104 facilitates the ease of installation and removal of the panels 84 such as the panel 96 and an adjacent panel 106 mounted in similar fashion on the pipes 92 and 94 to form a part of the side 18. Moreover, the panels 84 such as the panel 96 and the panel 106 may be made of canvas or similar flexible sheet material to facilitate storage as well as ease of installation on and removal from the frame 82. Such panels are easily rolled into a light weight, compact configuration for storage, which facilitates providing multiple sets of the panels so that the children's play structure 80 can be provided with different scenes or environmental themes. Each panel is easily installed on one of the hinging sections of the frame 82 in an operation which takes but a few seconds, and is just as easily removed therefrom. In the case of the panel 96, for example, such panel is installed to form part of the back 16 by wrapping the upper edge 98 around the pipe 18 and pressing the opposing pairs of velcro patches 102 and 104 together. The panel 96 is then extended downwardly along the back 16, and the lower edge 100 is wrapped around the pipe 90 and is secured to the panel 96 using pairs of the velcro patches 102 and 104. Removal of the panel 96 requires a simple reversal of such procedure in which the pairs of velcro patches 102 and 104 at the upper and lower edges 98 and 100 are pulled apart to permit removal of the panel 96.

Each of the panels 84 in the children's play structure 80, such as the panel 96 and the panel 106, is preferably provided with a mural or scene on each of the opposite sides thereof. In this manner, the desired theme or environment is created on the inside of the play structure 80, while at the same time the outside of the play structure 80 is provided with a desired appearance. The overlapping portions of the upper and lower edges 98 and 100 are preferably provided with a continuation of the scene or mural on the inside of the panel 96 so as to enhance the realism of the play structure 80 while at the same time covering the frame 82 from view.

FIG. 7 shows the common pivotable columnar structure 86 of FIG. 5 in detail. A substantial vertical portion of the structure 86 between the opposite upper and lower ends thereof is eliminated from FIG. 7 for simplicity of illustration.

As shown in FIG. 7, an upper end 108 of the structure 86 includes a bracket 110 having a cap portion 112 with a central aperture 114 therein, and a laterally extending portion 116 having a central aperture 118 therein. The central aperture 114 secures the upper end of an elongated rod 120 therein to mount the bracket 110 on the upper end of the rod 120. The central aperture 118 within the laterally extending portion 116 receives one end of a plug 122 having a collar 124 extending from the outside of an intermediate portion thereof. An opposite end of the plug 122 extends into the open end of the pipe 88 forming the upper horizontal frame member of the back 16 of the frame 82.

The bracket 110 has a circular recess 126 at the underside of the cap portion 112 thereof for receiving a circular flange 128 at the upper end of a holder 130 to permit pivoting rotational movement of the bracket 110 relative to the holder 130. The holder 130 which has a central aperture 132 therein has a laterally extending portion 134 with a central aperture 136 therein for receiving one end of a plug 138 having a configuration similar to the plug 122. The plug 138 which has a collar 140 thereon has an opposite end disposed within an open end of the pipe 92 forming the upper horizontal frame member of the side 18 of the frame 82.

The circular recess 126 within the cap portion 112 of the bracket 110 and the circular flange 128 on the holder 130 form a bearing which facilitates pivoting rotational movement of the bracket 110 relative to the holder 130. As the bracket 110 rotates relative to the holder 130, the rod 120 which is secured within the underside of the cap portion 112 rotates within a hollow tube 142 having an upper end mounted within the central aperture 132 in the holder 130. The hollow tube 142 is concentrically disposed about the rod 120. Both the rod 120 and the hollow tube 142 extend along the entire length of the common pivotable columnar structure 86 from the upper end 108 to a lower end 144 thereof.

At the lower end 144 of the common pivotable columnar structure 86, a lower end of the rod 120 is secured within a central aperture 146 in a capped portion 148 of a bracket 150 having a configuration like that of the bracket 110, at the upper end 108. As in the case of the bracket 110, the bracket 150 has a laterally extending portion 152 with a central aperture 154 therein for receiving one end of a plug 156 which is similar to the plugs 122 and 138. The plug 156 has an opposite end disposed within the open end of the pipe 90 forming the lower horizontal frame member of the back 16 of the frame 82. The bracket 150 also has a circular recess 158 within the cap portion 148 for receiving and forming a bearing with a circular flange 160 on a holder 162. The holder 162 which is configured like the holder 130 at the upper end 108 has a central aperture 164 therein in which the lower end of the hollow tube 142 is secured. The holder 162 also has a laterally extending portion 166 with a central aperture 168 therein for receiving one end of a plug 170 which is configured like the plugs 122, 138 and 156. An opposite end of the plug 170 is received within the open end of the pipe 94 forming the lower horizontal frame member of the side 18 of the frame 82.

The brackets 110 and 150 pivot together relative to the holders 130 and 162, allowing the back 16 to undergo pivoting movement relative to the side 18 of the frame 82. The rod 120 which has its opposite ends secured, such as by gluing, within the cap portion 112 of the bracket 110 and the cap portion 148 of the bracket 150, rotates within the hollow tube 142 as the pipes 88 and 90 comprising part of the back 16 undergo movement relative to the pipes 92 and 94 comprising part of the side 18 of the frame 82. The opposite ends of the hollow tube 142 are secured such as by gluing within the holders 130 and 162.

The common pivotable columnar structure 86 shown in FIG. 7 provides a relatively simple, lightweight and inexpensive way of fabricating the frame 82 of the children's play structure 80. In addition to the pipes 88, 90, 92 and 94, the brackets 110 and 150, the holders 130 and 162, the rod 120, the hollow tube 142, and even the plugs 122, 138, 156 and 170 can be made of polyvinylchloride (PVC) or other lightweight and inexpensive material. The common pivotal columnar structure 86 forms common vertical members for both of the hinging sections of the frame, such as the back 16 and the side 18 in the case of FIG. 5, even further simplifying the construction of the frame 82.

Although the rod 120 and the hollow tube 142 are securely fastened within the brackets 110 and 150 and the holders 130 and 162, such as by gluing, the plugs 122, 138, 156 and 170 are preferably seated within the apertures in the brackets, the holders and the pipes by a simple frictional interference fit in order to permit removal. In this manner the pipes 88 and 90 can be removed from the brackets 110 and 150, and the pipes 92 and 94 can be removed from the holders 130 and 162, to permit disassembly of the frame 82 and thereby facilitate storage thereof.

As previously noted, the frame 82 of the children's play structure 80 is configured so as to include the back 16, the opposite sides 18 and 20 and the two hinging front sections 22 and 24 in the manner of the frame 12 of FIG. 1, even though only portions of the back 16 and the side 18 are shown in FIG. 5. As such, four of the common pivotable columnar structures 86 are required within the frame 82 to form the pivotable interfaces between the hinging front section 22 and the side 18, between the hinging front section 24 and the side 20, and between the side 20 and the back 16, as well as between the back 16 and the side 18. Inasmuch as the opposite vertical edges of the two hinging front sections 22 and 24 are not joined to and pivotable relative to other hinging sections, these portions of the frame 82 are simply formed by vertical lengths of pipe joined at the top and bottom ends thereof by conventional pipe elbows to the pipes forming the upper and lower horizontal frame members within the two hinging front sections 22 and 24.

As previously noted, the third embodiment shown in FIGS. 5–7 is regarded as the preferred embodiment. The frame 82 thereof is of relatively simple, lightweight and inexpensive construction and is easily disassembled for storage and then reassembled when desired. In addition, the panels 84 are easily installed and removed, and can easily be folded or rolled for storage.

It will be appreciated that children's play structures in accordance with the invention provide the ability to easily change the theme or environment thereof with easy replacement of a multi-panel member or individual panels in conjunction with a foldable, portable frame of relatively simple and inexpensive construction. In addition to a multi-panel member or a plurality of individual panels providing the classroom theme or environment as shown, other replacement members or panels can provide a variety of different themes or environments as previously noted.

While the invention has been particularly shown and described with reference to preferred embodiments thereof, it will be understood by those skilled in the art that changes in form and details may be made therein without departing from the spirit and scope of the invention.

What is claimed is:

1. A children's play apparatus capable of being arranged into a generally enclosed free-standing structure, said apparatus comprising:

an apparatus frame comprised of a plurality of hingedly connected sections, each section being generally rectangular and comprising a peripheral section frame formed by an upper frame member, a generally opposite lower frame member and two side frame members, said frame members being generally coplanar and generally perpendicular with respect to each other to form an open center, each section being hingedly connected to another section adjacent to one of the side frame members of each section; and at least one panel of cloth-like material having a periphery including an upper edge and a generally opposite lower edge and carrying periphery engagement means for removably attaching the at least one panel to the apparatus frame to provide a scene creating a play environment, wherein the at least one panel is removably attached to said apparatus frame, at least a portion of said material wrapped around at least a portion of the upper and lower frame members, said periphery engagement means comprising at least one hook and loop fastening member mounted adjacent to the periphery on a first side of the at least one panel releaseably connected to at least one complimentary hook and loop fastening member mounted on a second side opposed to the first side of the at least one panel.

2. The apparatus according to claim 1, wherein the at least one panel is removably attached to the plurality of sections, at least portions of the generally opposite upper and lower edges wrapped around the respective opposite upper and lower frame members of the sections.

3. A children's play apparatus comprising the combination of:

a frame capable of being formed into a free-standing structure; and at least one panel adapted to be removably mounted on the frame;

the frame being comprised of a plurality of hinging frame sections, at least two of which are coupled together by a common pivotable columnar structure, the common pivotable columnar structure including a rod coupled by a pair of brackets at opposite ends of the rod to one of the at least two hinging frame sections and a hollow tube concentrically disposed about the rod and coupled by a pair of holders at opposite ends of the tube to the other one of the at least two hinging frame sections.

4. Apparatus according to claim 3, wherein the pair of brackets are pivotably coupled to the pair of holders.

5. A children's play apparatus comprising the combination of:

a frame capable of being formed into a free-standing structure; and at least one panel adapted to be removably mounted on the frame;

the frame being comprised of a plurality of hinging frame sections, at least two of which are coupled together by a common pivotable columnar structure, the common pivotable columnar structure including a pair of brackets at top and bottom ends thereof and a pair of holders at top and bottom ends thereof and capable of undergoing pivoting movement relative to the brackets, one of the at least two of the hinging frame sections including upper and lower frame members coupled with a pair of brackets and the other one of the at least two hinging frame sections including upper and lower frame members coupled to the pair of holders.

6. Apparatus according to claim 5, wherein the upper and lower frame members of the at least two of the hinging frame sections are removeably coupled to the pair of brackets and the upper and lower frame members of the other one of the at least two hinging frame sections are removeably coupled to the pair of holders, to facilitate disassembly of the frame.

7. Apparatus according to claim 6, wherein the upper and lower frame members of the one of the at least two hinging frame sections are removably coupled to the pair of brackets by plugs removably inserted in hollow interiors of the upper and lower frame members and in central apertures in the pair of brackets, and the upper and lower frame members of the other one of the at least two of the hinging frame sections are removably coupled to the pair of holders by plugs removably inserted in hollow interiors of the upper and lower frame members and in central apertures in the pair of holders.

* * * * *